US008705997B2

(12) United States Patent
Suzuki et al.

(10) Patent No.: US 8,705,997 B2
(45) Date of Patent: Apr. 22, 2014

(54) IMAGE FORMING APPARATUS THAT SELECTIVELY CHANGES CURRENT-FEED RATIO

(75) Inventors: Takashi Suzuki, Nagoya (JP); Yuki Fukusada, Kasugai (JP); Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 88 days.

(21) Appl. No.: 13/414,661

(22) Filed: Mar. 7, 2012

(65) Prior Publication Data

US 2012/0230717 A1 Sep. 13, 2012

(30) Foreign Application Priority Data

Mar. 8, 2011 (JP) ..... 2011-050460

(51) Int. Cl.
*G03G 15/20* (2006.01)

(52) U.S. Cl.
USPC ..... 399/69

(58) Field of Classification Search
USPC ..... 399/68, 69, 45; 219/216
See application file for complete search history.

(56) References Cited

U.S. PATENT DOCUMENTS 5,464,964 A 11/1995 Okuda et al.
5,669,038 A 9/1997 Kishimoto
6,301,454 B1 10/2001 Nishida et al.
7,015,431 B2 * 3/2006 Yoshimura ..... 219/216
8,331,819 B2 * 12/2012 Fukuzawa et al. ..... 399/69
8,340,543 B2 12/2012 Ogiso et al.
2003/0072581 A1 4/2003 Nishida
2009/0290893 A1 11/2009 Ogiso et al.
2009/0297199 A1 12/2009 Yamashina et al.
2012/0230744 A1 9/2012 Maruyama et al.
2012/0301171 A1 11/2012 Maruyama

FOREIGN PATENT DOCUMENTS

JP H05-289562 A 11/1993
JP H08-297429 A 11/1996

(Continued)

OTHER PUBLICATIONS

Machine translation of JP JP 2009-282162 (published on Dec. 3, 2009) dated Aug. 15, 2013.*

(Continued)

*Primary Examiner* — Sophia S Chen
(74) *Attorney, Agent, or Firm* — Baker Botts L.L.P.

(57) ABSTRACT

An image forming apparatus includes a fusing unit configured to fuse an image formed on a recording medium to a recording medium, at a fusing position where a heater and a rotator nip the recording medium therebetween, and a current-feed controller configured to execute a first current-feed mode of changing a current-feed ratio of current-feed time from an AC power source to the heater to unit time by controlling switching of a switching circuit so that a temperature detected by a temperature detector falls within a target range. The current-feed controller executes a second current-feed mode of fixing the current-feed ratio to almost 100% or almost 0% in place of the first current-feed mode based on a timing when a position detector detects that an end of the recording medium in a conveying direction is located at the fusing position.

14 Claims, 6 Drawing Sheets

(56) References Cited

FOREIGN PATENT DOCUMENTS

| | | | |
|---|---|---|---|
| JP | H10-091037 | A | 4/1998 |
| JP | H10-213996 | A | 8/1998 |
| JP | 2002-116669 | A | 4/2002 |
| JP | 2002-182521 | A | 6/2002 |
| JP | 2002-278351 | A | 9/2002 |
| JP | 2004-191710 | A | 7/2004 |
| JP | 2005-012977 | A | 1/2005 |
| JP | 2007-003663 | A | 1/2007 |
| JP | 2007-047559 | A | 2/2007 |
| JP | 2008-122757 | A | 5/2008 |
| JP | 2009-282162 | A | 12/2009 |

OTHER PUBLICATIONS

European Patent Office, extended European Search Report for European Patent Application No. 12158289.4 (counterpart European patent application), dated May 10, 2013.

Japan Patent Office, Notification of Reasons for Refusal for Japanese Patent Application No. 2011-050452 (counterpart Japanese patent application), dispatched Jan. 29, 2013.

Japan Patent Office, Notification of Reasons for Refusal for Japanese Patent Application No. 2011-050460 (counterpart Japanese patent application), dispatched Mar. 28, 2013.

Japan Patent Office, Notification of Reasons for Refusal for Japanese Patent Application No. 2011-050460 (counterpart to above-captioned patent application), mailed May 30, 2013.

* cited by examiner

IMAGE FORMING APPARATUS THAT SELECTIVELY CHANGES CURRENT-FEED RATIO

CROSS REFERENCE TO RELATED APPLICATION

This application claims priority from Japanese Patent Application No. 2011-050460 filed on Mar. 8, 2011, The entire content of this priority application is incorporated herein by reference.

TECHNICAL FIELD

The present invention relates to an image forming apparatus, in particular, to a technique of restraining occurrence of high frequency wave in current-feed to a fusing unit of the image forming apparatus.

BACKGROUND

As a conventional technique of restraining occurrence of high frequency wave, in other word, harmonic current in current-feed to a fusing unit of an image forming apparatus, for example, a technique is known which turns on the current-feed by 100% when a heater temperature is equal to or lower than a lower limit value, turns off the current-feed when the heater temperature is higher than an upper limit value and periodically turns on/off a sine-wave alternating current (AC) in synchronization with a zero cross of the sine-wave AC when the heater temperature falls between the upper limit value and the lower limit value.

According to the above-mentioned conventional technique, high frequency wave occurring at turning-on/off of the sine-wave AC can be reduced. However, in recent years, a more strict standard value of a harmonic current in heaters has been set and therefore, in controlling heating of the fusing unit, a technique of further restraining the harmonic current while restraining instability of the temperature of the fusing unit is in demand.

The present invention provides a technique of improving the effect of restraining the harmonic current in controlling heating of the fusing unit while restraining instability of the temperature of the fusing unit.

SUMMARY

An image forming apparatus disclosed in this specification includes a conveying unit configured to convey a recording medium, an image forming unit configured to form an image on the conveyed recording medium, a fusing unit including a heater that receives electric power from an AC power source and a rotator that is disposed as opposed to the heater and rotates to convey the recording medium, the fusing unit configured to fuse the image formed on the recording medium to the recording medium due to heating by the heater at a fusing position as a position where the heater and the rotator nip the recording medium therebetween, a switching circuit configured to switch on/off current-feeding from the AC power source to the heater, a temperature detector configured to detect temperature of the heater, a current-feed controller configured to execute a first current-feed mode of changing a current-feed ratio of current-feed time from the AC power source to the heater to unit time by controlling switching of the switching circuit so that the temperature detected by the temperature detector falls within a target range, and a position detector that detects position of the conveyed recording medium. The current-feed controller executes a second current-feed mode of fixing the current-feed ratio to almost 100% or almost 0% during execution of the first current-feed mode in place of the first current-feed mode based on a timing when the position detector detects that an end of the recording medium in a conveying direction is located at the fusing position.

DETAILED DESCRIPTION OF THE ILLUSTRATIVE ASPECTS

Figure 1:
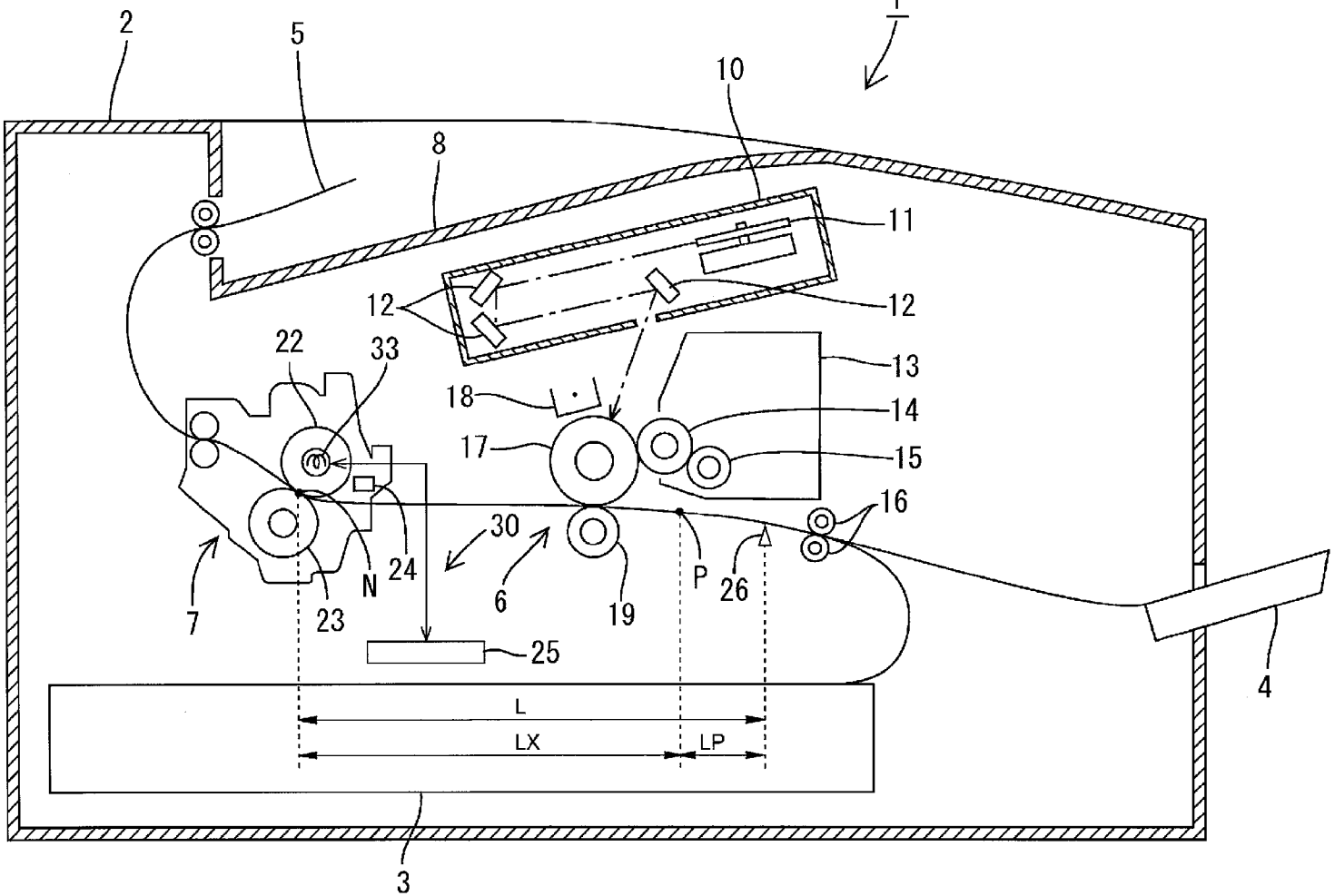
FIG. 1 is a side sectional view showing a schematic configuration of an image forming apparatus according to an illustrative aspect.

Next, one illustrative aspect will be described with reference to FIGS. 1 to 6, 1. Configuration of Laser Printer FIG. 1 is a view schematically showing a vertical cross section of a monochrome laser printer 1 (an example of an "image forming apparatus") according to the first illustrative aspect. The image forming apparatus is not limited to the monochrome laser printer, and for example, may be a color laser printer, a color LED printer or a multiple function machine or the like.

In the monochrome laser printer (hereinafter referred to as a "printer") 1, a registration roller 16 adjusts the position of a sheet 5 fed from a tray 3, which is disposed in a lower portion of a body casing 2, or from a tray 4, and an image forming unit 6 forms the toner image. Then a fusing unit 7 heats the toner image to perform fusing process and finally, the sheet (an example of a recording medium) 5 is ejected to a sheet output tray 8 located in an upper portion of the body casing 2. A post-registration sensor (an example of a position detector) 26 that detects position of the conveyed sheet 5 is provided downstream from the registration roller 16 in a sheet conveying direction.

The image forming unit 6 includes a scanner unit 10, a developing cartridge 13, a photoconductive drum 17, an charging unit 18 and a transfer roller 19 and the like.

The scanner unit 10 is disposed in the upper portion of the body casing 2 and includes a laser light emitting part (not shown), a polygon mirror 11, a plurality of reflecting mirrors 12 and a plurality of lenses (not shown) and the like. The scanner unit 10 irradiates the surface of the photoconductive drum 17 with laser light emitted from the laser light emitting part through the polygon mirror 11, the reflecting mirrors 12 and the lenses by high-speed scanning as represented by a dashed line.

The developing cartridge 13 is detachably attached to the body casing 2 and stores toner therein. A developing roller 14 and a feeding roller 15 are provided at a toner feeding port of the developing cartridge 13 as opposed to each other, and the developing roller 14 is also disposed as opposed to the photoconductive drum 17. The toner stored in the developing cartridge 13 is fed to the developing roller 14 with rotation of the feeding roller 15, and carried by the developing roller 14.

The charging unit 18 is disposed above the photoconductive drum 17 with an interval therebetween. The transfer roller 19 is disposed below the photoconductive drum 17 as opposed to the photoconductive drum 17.

While being rotated, the surface of the photoconductive drum 17 is charged uniformly, for example, positively charged by the charging unit 18. Next, an electrostatic latent image is formed on the photoconductive drum 17 by the laser light from the scanner unit 10, and then, the photoconductive drum 17 contacts with the developing roller 14 and rotates. At this time, the toner carried on the developing roller 14 is fed to the electrostatic latent image on the photoconductive drum 17 and carried thereon to form a toner image. After that, while the sheet 5 passes between the photoconductive drum 17 and the transfer roller 19, the toner image is transferred to the sheet 5 by transfer bias applied to the transfer roller 19.

The fusing unit 7 is disposed downstream from the image forming unit 6 in a sheet conveying direction and includes a fusing roller (an example of a heater) 22, a pressure roller (an example of a rotator) 23 pressing the fusing roller 22 and a halogen heater (an example of the heater) 33 heating the fusing roller 22 and the like. The halogen heater 33 is provided within the fusing roller 22 and is connected to a circuit board 25 for current-feed control according to a signal from the circuit board 25. Here, the fusing roller 22 and the halogen heater 33 constitute the heater. The sheet 5 is nipped at a position where the fusing roller 22 and the pressure roller 23 are opposed to each other and at the nip position (corresponding to the fusing position) N, the toner image is thermally fused to the sheet 5.

The configuration of the fusing unit 7 is not limited to this. For example, the fusing unit may be a fusing unit of so-called film fusing type using a fusing film in place of the fusing roller 22. In such case, the fusing film and the halogen heater constitute the heater.

A temperature sensor (an example of a temperature detector) 24 detecting temperature of the halogen heater 33 is provided in the vicinity of the halogen heater 33. The registration roller 16, the transfer roller 19 and the pressure roller 23 constitute a conveying unit that conveys the sheet 5.

2. Electric Configuration of Heating Apparatus

Figure 2:
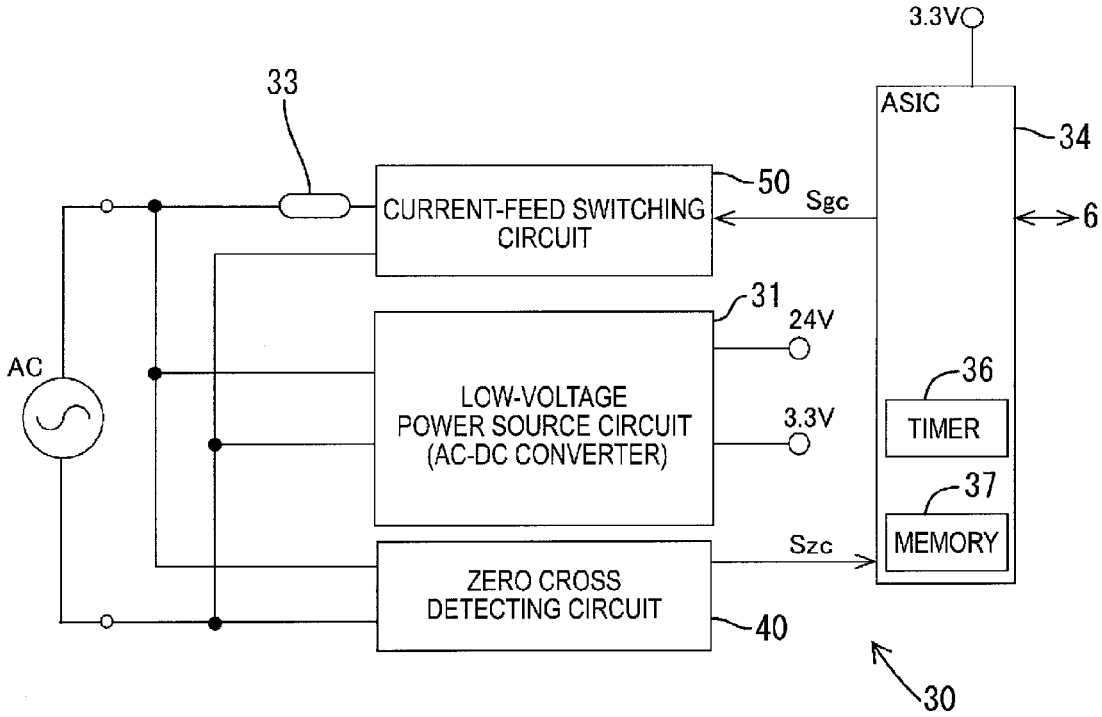
FIG. 2 is a block diagram showing a schematic configuration of a heating apparatus of the image forming apparatus.
Figure 3:
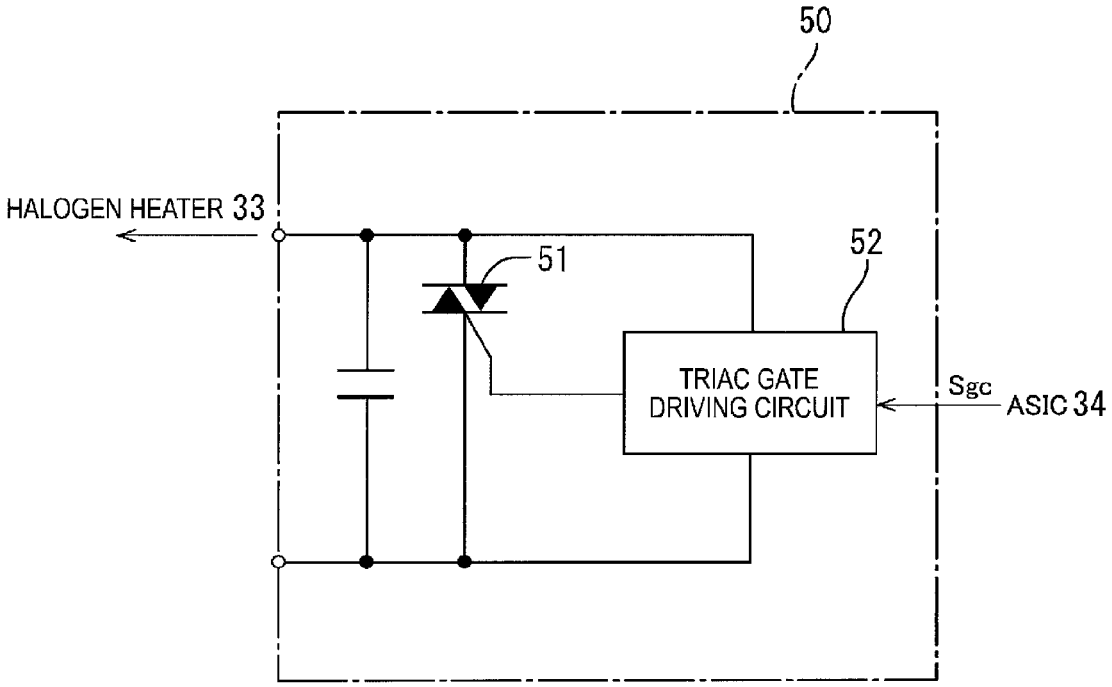
FIG. 3 is a block diagram showing a schematic configuration of a current-feed switching circuit of the heating apparatus.

Next, a heating apparatus 30 provided in the printer 1 will be described with reference to FIGS. 2 and 3. FIG. 2 is a block diagram showing a schematic configuration of the heating apparatus 30. FIG. 3 is a block diagram showing a schematic configuration of a current-feed switching circuit 50 of the heating apparatus 30.

The heating apparatus 30 includes a low-voltage power source circuit (AC-DC converter) 31, the halogen heater 33, an ASIC (Application Specific Integrated Circuit) 34, a zero cross detecting circuit 40 and a current-feed switching circuit (an example of a switching circuit) 50 and the like. Here, each circuit except for the halogen heater 33 is provided on the circuit board 25. The low-voltage power source circuit 31 is not necessarily included in the heating apparatus 30.

The low-voltage power source circuit 31 converts, for example, an AC voltage of 100 V into a DC voltage of 24 V and 3.3 V and feeds the DC voltage to each part. The halogen heater 33 generates heat according to current-feed of an AC power source AC.

The zero cross detecting circuit 40 generates a zero cross signal Szc in synchronization with a zero cross timing of the sine-wave alternating current power source (hereinafter referred to as AC power source) AC. The ASIC 34 controls current-feed of the current-feed switching circuit 50 in synchronization with the zero cross signal Szc.

Using the zero cross signal Szc as a reference, the current-feed switching circuit 50 adjusts a current-feed time of the AC power source AC to the halogen heater 33. Specifically, as shown in FIG. 3, the current-feed switching circuit 50 includes, for example, a triac 51 and a triac gate driving circuit 52. The triac gate driving circuit 52 receives a gate control signal Sgc from the ASIC 34 and turns on/off the triac 51 according to the gate control signal Sgc, thereby switching the turning on/off of the current-feed from the AC power source AC to the halogen heater 33.

The ASIC (an example of a current-feed controller and a position detector) 34 includes a timer 36 and a memory 37, and controls the current-feed switching circuit 50 to perform current-feed control of the fining unit 7. The ASIC 34 is connected to the image forming unit 6 and also performs controls related to image formation. The timer 36 is used to measure various current-feed time in current-feed control of the fusing unit 7. The timer (an example of the position detector) 36 is used to measure time in order to detect position of the sheet. The memory 37 includes a ROM and a RAM. The configuration of the current-feed controller is not limited to the ASIC 34 and may be, for example, a CPU or discrete circuits, Basically, the ASIC 34 executes a first current-feed mode of controlling switching of the triac 51 to change a wave-number duty ratio so that temperature detected by the temperature sensor 24 falls within a target range. During execution of the first current-feed mode, the ASIC 34 executes a second current-feed mode of fixing the wave-number duty ratio to almost 100% or almost 0% at a timing when the post-registration sensor 26 detects that an end of the sheet 5 in the conveying direction is located at a nip position N, in place of the first current-feed mode. Here, the wave-number duty ratio means a duty ratio in the case of wave-number control of the AC power source AC, and is an example of a current-feed ratio, The current-feed ratio means a ratio of current-feed (from the AC power source AC to the halogen heater 33) time to a unit time. The "DUTY ratio of almost 100%" includes DUTY ratio of 99% or 98%, and is not limited to the DUTY ratio 100%. The "duty ratio of almost 0%" includes a DUTY ratio of 1% or 2% and is not limited to DUTY ratio of 0%.

Figure 4:
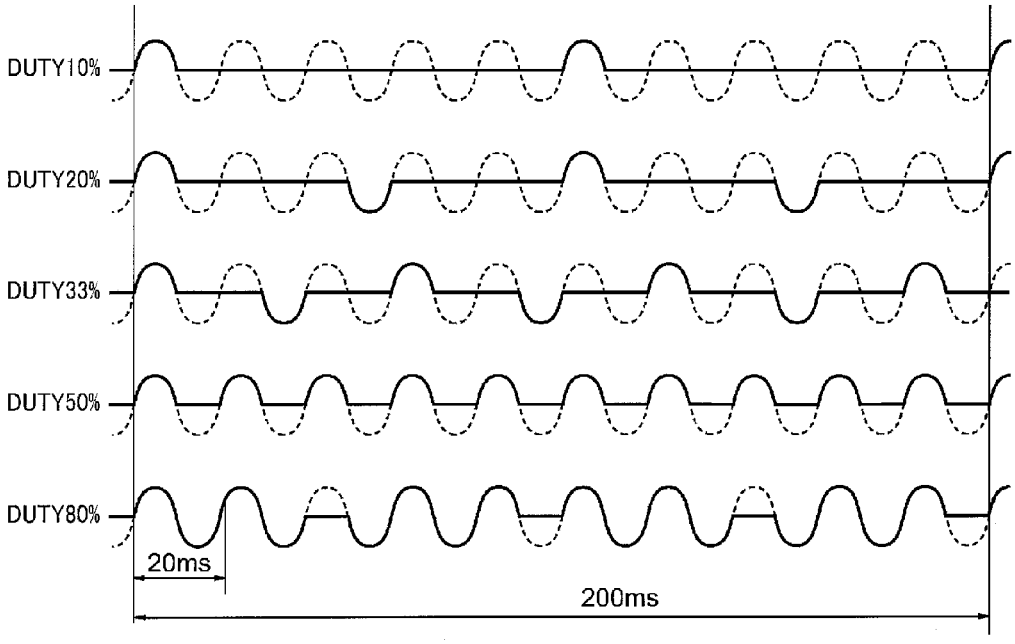
FIG. 4 is a timing chart showing an example of DUTY ratio and waveform pattern.

FIG. 4 is a timing chart showing a relationship between the wave-number duty ratio (hereinafter referred to as duty ratio) DUTY and a current-feed waveform pattern, and according to this illustrative aspect, wave-number control is performed in units of half wave. Specifically, when the frequency of the AC power source AC is set to 50 Hz, the cycle of the AC power source AC is 20 milliseconds (ms), and here, when the unit time is set to 200 ms, the wave number for the unit time becomes "10". For example, as shown in FIG. 4, a half-wave pattern in the case of the wave-number duty ratio DUTY of 20% becomes the current-feed waveform pattern in which one half wave becomes effective in units of five half waves. The pattern is repeated four times for the unit time (200 ms) and the wave number for the unit time is 4×half wave=2. That is, in this case, the wave-number duty ratio DUTY is (2/10)×100=20%. The unit time of "200 ms" herein is measuring unit time in obtaining the high frequency amount.

Generally, a harmonic current value (secondary harmonic average value) at each wave-number duty ratio DUTY becomes larger according to the number of times of turning on/off switching of the AC power source AC in units of half wave. That is, at the duty ratio DUTY of 0% and 100%, switching is not performed, resulting that a harmonic current value becomes smallest. At the wave-number duty ratio DUTY of 20%, the harmonic current value increases and becomes almost the same value as that at the DUTY of 80%. The harmonic current value increases at the DUTY of 30% (or 70%) and becomes largest at the DUTY of 50%.

Since the number of times of turning on/off switching varies according to the mode of the waveform pattern, the harmonic current varies even at the same duty ratio DUTY. Generally in wave-number control, each current-feed waveform pattern is determined so as to fall within the range of the harmonic current standard value relative to each set current-feed wave-number duty ratio DUTY. Alternatively, wave-number control is performed so as to satisfy the standard of the harmonic current by avoiding the wave-number duty ratio DUTY that falls outside of the range of the harmonic current standard value in the set waveform pattern.

3. Current-feed Control of Heating Apparatus (Fusing Unit)

Figure 5:
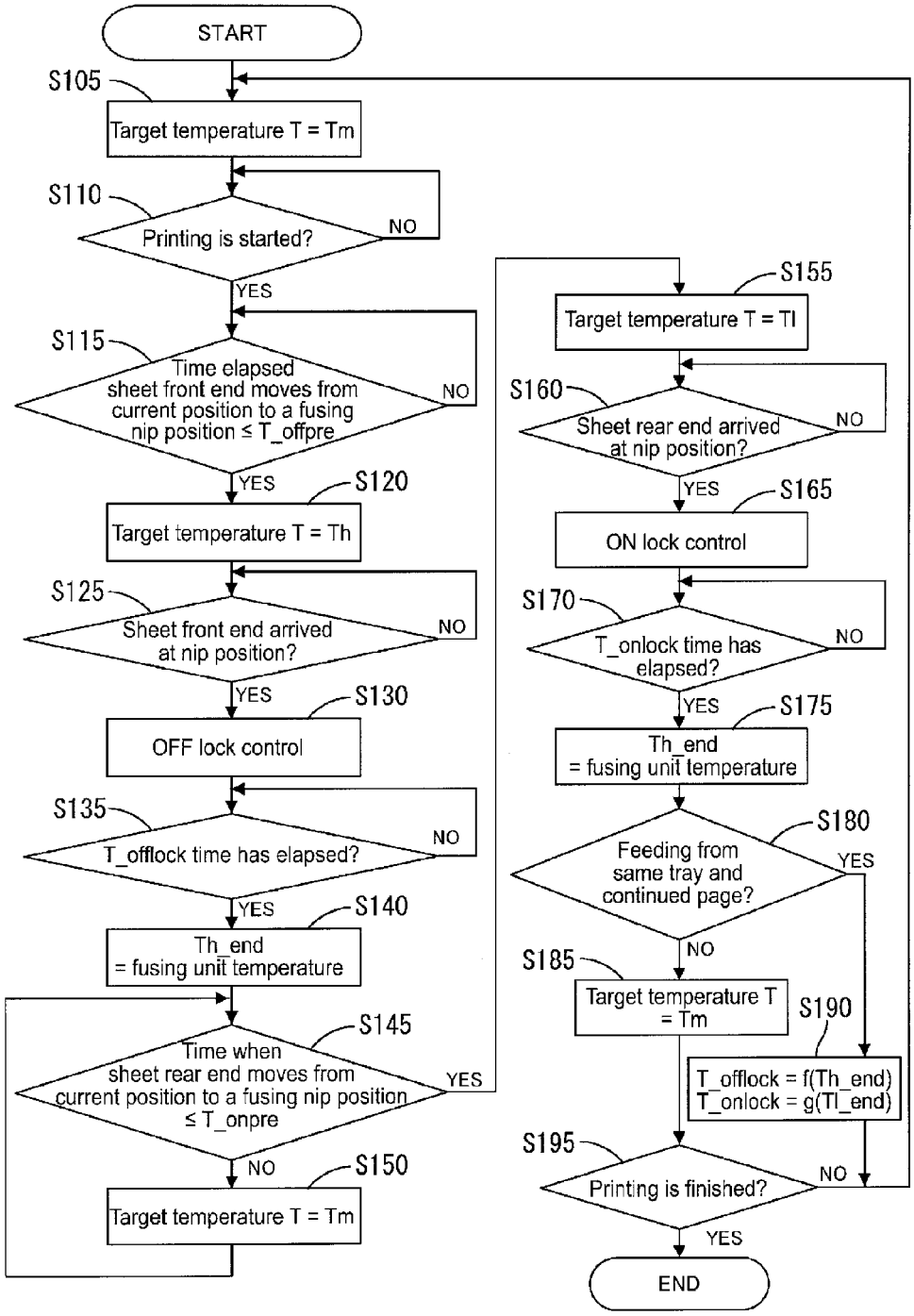
FIG. 5 is a flow chart showing a current-feed control.
Figure 6:
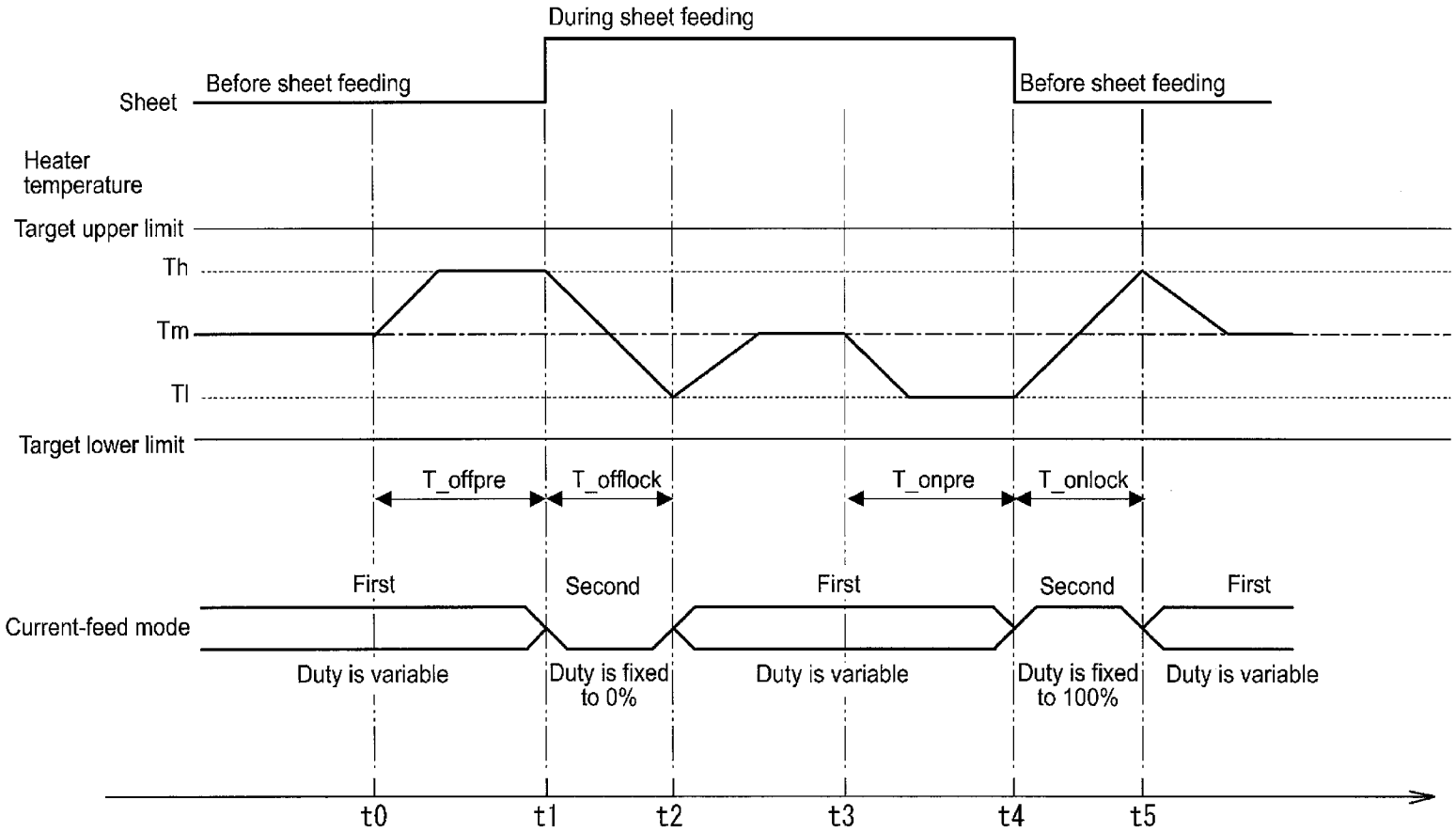
FIG. 6 is a timing chart according to current-feed control.

Next, current-feed control of the fusing unit 7 according to this illustrative aspect will be described with reference to FIGS. 5 and 6. FIG. 5 is a flow chart showing each step of current-feed control of the fusing unit. FIG. 6 is a timing chart showing current-feed control according to fusing process of one sheet 5.

For example, when the user issues a printing command to the printer 1, the ASIC 34 performs current-feed control of the fusing unit 7 according to a predetermined program stored in the memory 37. The ASIC 34 performs current-feed control processing based on the temperature detected by the temperature sensor 24 and detection of the sheet 5 by the post-registration sensor 26.

When the processing starts, the ASIC 34 first sets a specification target temperature Tm as a heating target temperature T of the fusing unit 7 and performs wave-number control so that a sensor detection temperature Td becomes the specification target temperature Tm (Step S105). That is the ASIC 34 executes the first current-feed mode of changing the wave-number duty ratio so that the sensor detection temperature Td becomes the specification target temperature Tm.

Next, it is determined whether or not printing is started (Step S110). When it is determined that printing is started (YES in Step S110), the ASIC 34 determines whether or not an arrival time Kt is equal to or smaller than a pre-OFF lock time (period) T_offpre (Step S115). The arrival time Kt means a period in which a front end of the sheet moves from a current position P to the nip position N of the fusing unit 7. When it is determined that the arrival time Kt is equal to or smaller than the pre-OFF lock time T_offpre (YES in Step S115), the ASIC 34 sets a pre-OFF lock target temperature Th as the heating target temperature T for the fusing unit 7 (corresponding to Time t0 in FIG. 6) and executes the first current-feed mode of changing the duty ratio so that the sensor detection temperature Td becomes the pre-OFF lock target temperature Th (Step S120).

Here, the arrival time Kt is calculated by the ASIC 34, for example, according to a following equation. As shown in FIG. 1, it is given that a distance between the post-registration sensor 26 and the nip position N is "L", the current position of the front end of the sheet 5 is "P", a distance between the post-registration sensor 26 and the position P of the front end of the sheet 5 is "Lp", a distance between the position P of the front end of the sheet 5 and the nip position N is "Lx", a sheet convey time elapsed when the sheet is conveyed from the post-registration sensor 26 to the position P of the front end of the sheet 5 is "Δt" and a sheet convey speed is "v".

$$Kt=Lx/v=(L-Lp)/v=(L-\Delta tv)/v=(L/v)-\Delta t$$

Since "L" and "v" are known, the arrival time Kt in which the front end of the sheet 5 moves from the current position P to the nip position N can be calculated by measuring the sheet convey time Δt, that is, the elapsed time Δt between the time when the front end of the sheet 5 is detected by the post-registration sensor 26 and current time, by use of the timer 36.

Next, the ASIC 34 determines whether or not the front end of the sheet 5 arrived at the nip position N (Step S125). This determination is made, for example, based on whether or not the elapsed time Δt arrives at L/v. When it is determined that the front end of the sheet 5 arrived at the nip position N (YES in Step S125), OFF lock control is started (corresponding to Time t1 in FIG. 6). In OFF lock control (Step S130), during a predetermined OFF lock time T_offlock (period from Time t1 to t2 in FIG. 6), the duty ratio DUTY is fixed to almost 0%, thereby turning off the current-feed of the halogen heater 33. For this reason, during the OFF lock time T_offlock, the heater temperature (sensor detection temperature Td) lowers (refer to FIG. 6).

It is preferred that the OFF lock time T_offlock is a period during which the front end of the sheet 5 is located at the nip position N and then, the pressure roller 23 makes a single rotation. In this case, during the above-mentioned period, the temperature of the fusing roller 22 can be lowered by absorbing heat by the sheet 5 and executing the second current-feed mode of fixing the duty ratio DUTY to almost 0%. Thus, even in the case where the halogen heater 33 (heater) is heated to upper limit temperature or higher before fusing, thermal runaway can be restrained. That is the effect of restraining the harmonic current can be improved while restraining instability of the temperature of the halogen heater 33.

Next, the ASIC 34 determines whether or not the OFF lock time T_offlock has elapsed (Step S135). When it is determined that the OFF lock time T_ofilock has elapsed (YES in Step S135, corresponding to Time t2 in FIG. 6), the ASIC 34 sets the temperature of the fusing unit at this time, that is, the sensor detection temperature Td to "Th_end" (Step S140). Then, the ASIC 34 determines whether or not an arrival time Kb is equal to or smaller than a predetermined pre-ON lock time T_onpre (Step S145). The arrival time Kb means a period in which a rear end of the sheet moves from a current position to the nip position N of the fusing unit 7. The arrival time Kb is calculated according to the same method as the method of calculating the above-mentioned arrival time Kt. That is, the arrival time Kb is calculated by measuring elapsed time Δt between detection of the rear end of the sheet 5 by the post-registration sensor 26 and the current time by use of the timer 36.

When it is determined that the arrival time Kb is larger than the predetermined pre-ON lock time T_onpre (NO in Step S145), the ASIC 34 sets the specification target temperature Tm as the heating target temperature T for the fusing unit 7 again (Step S150), and executes the first current-feed mode of changing the duty ratio so that the sensor detection temperature Td becomes the specification target temperature Tm (corresponding to a period from Time t2 to t3 in FIG. 6). When it is determined that the arrival time Kb is equal to or smaller than the predetermined pre-ON lock time T_onpre (YES in Step S145), the ASIC 34 sets the target temperature T as a pre-ON lock target temperature T1 (substantially corresponding to Time t3 in FIG. 6), and executes the first current-feed mode of changing the duty ratio so that the sensor detection temperature Td becomes the pre-ON lock target temperature T1 (Step S155).

Next, the ASIC 34 determines whether or not the rear end of the sheet 5 arrives at the nip position N (Step S160). This determination is made, for example, based on whether or not the elapsed time At arrives at L/v as in Step S125. When it is determined that the rear end of the sheet 5 arrives at the nip position N (YES in Step S160), ON lock control is started (corresponding to Time t4 in FIG. 6). In ON lock control (Step S165), a predetermined ON lock time T_onlock (period from Time t4 to t5 in FIG. 6), the duty ratio DUTY is fixed to almost 100%, thereby turning on the current-feed of the halogen heater 33. For this reason, during the ON lock time T_onlock, the heater temperature (sensor detection temperature Td) rises (refer to FIG. 6).

It is preferred that the ON lock time T_onlock is a period during which the rear end of the sheet S is located at the nip position N and then, the pressure roller 23 makes a single rotation. During the above-mentioned period, the temperature of the pressure roller 23 lowers and thus, is harder to rise than the temperature after single rotation of the pressure roller 23. Accordingly, the second current-feed mode of fixing the duty ratio DUTY to almost 100% can suitably be executed. As a result, the effect of restraining the harmonic current can be improved while restraining instability of the temperature of the heater.

Next, the ASIC 34 determines whether or not the ON lock time T_onlock has elapsed (Step S170). When it is determined that the ON lock time T_onlock has elapsed (YES in Step S170, corresponding to Time t5 in FIG. 6), the ASIC 34 sets the temperature of the fusing unit at this time, that is, the sensor detection temperature Td to "T1_end" (Step S175).

Next, the ASIC 34 determines whether or not the sheet is fed from the same tray and a continued page is printed (Step S180). When the sheet is not fed from the same tray and a continued page is not printed (NO in Step S180), the target temperature T is set to the specification target temperature Tm (Step S185). Then, it is determined whether or not a printing job is finished (Step S195), and when it is determined that the printing job is not finished (NO in Step S195), the procedure returns to Step S105. When it is determined that the printing job is finished (YES in Step S195), processing is finished.

When, in Step S180, the sheet is fed from the same tray and a continued page is printed (YES in Step S180), the OFF lock time T_offlock is set based on "Th_end", the ON lock time T_onlock is set based on "T1_end" (Step S190) and the procedure returns to Step S105.

In setting the OFF lock time T_offlock and the ON lock time T_onlock in Step S190, each time images are continuously formed on a plurality of sheets 5, for example, it is preferred to gradually increase an execution period of the second current-feed mode from an initial value. In the case of continuous image formation, since the sheets 5 are generally uniform in material and size, a generally provided control margin of fusing temperature can be gradually decreased and by gradually increasing the execution period of the second current-feed mode according to this decrease, the effect of restraining the harmonic current can be further improved.

When a feeding source (sheet-feed tray) for the sheet 5 is changed, at return from Step S190 to Step S105, it is preferred that the OFF lock time T_offlock and the ON lock time T_onlock as the execution periods of the second current-feed mode are reset to initial values. Since size of material of the sheet 5 is usually changed with change in the sheet tray, the control margin of the fusing temperature must be reset to a normal value (initial value), and accordingly, by resetting the execution period of the second current-feed mode to the initial value, the effect of restraining the harmonic current can be improved while restraining instability of the temperature of the heater.

4. Effects of Illustrative Aspect

As described above, according to this illustrative aspect, the ASIC 34 executes the second current-feed mode of fixing the DUTY ratio to 0% at Time t1 when the front end of the sheet 5 arrives at the nip position N of the fusing unit 7, and executes the second current-feed mode of fixing the duty ratio to 100% at Time t4 when the rear end of the sheet 5 arrives at the nip position N of the fusing unit 7. That is, the ASIC 34 executes the second current-feed mode of fixing the duty ratio to almost 100% or almost 0% during the first current-feed mode of changing the duty ratio (DUTY) of wave-number control in place of the first current-feed mode based on the timing when the position detector detects that the end of the sheet 5 in the conveying direction, in other words, the front end of the sheet 5 is located at the nip position N.

Thus, by suitably using the mode of thermal diffusion that varies depending on presence/absence of nipping of the sheet 5 at the fusing unit 7, the effect of restraining the harmonic current can be improved. That is, in heating control, the effect of restraining the harmonic current can be improved while restraining instability of the temperature of the fusing unit 7.

The ASIC 34 also executes the first current-feed mode in the pre-OFF lock time T_offpre as a period prior to arrival of the front end of the sheet 5 at the nip position N of the fusing unit 7 so that a detection temperature Td becomes equal to or higher than the target temperature Tm at Time t1 when the front end of the sheet 5 arrives at the nip position N of the fusing unit 7. After the front end of the sheet 5 arrives at the nip position N of the fusing unit 7, the temperature of the halogen heater 33 lowers due to absorption of heat by the sheet 5. For this reason, by previously setting the detection temperature Td to be equal to or larger than the target temperature Tm, the second current-feed mode of fixing the duty ratio to almost 0% can suitably be executed in the above-mentioned OFF lock time T_offlock. Therefore, the effect of restraining the harmonic current can be improved while decreasing the temperature of the heater, that is, restraining instability of the temperature of the heater. Preferably, by previously setting the detection temperature Td to be not less than the target temperature Tm and not more than upper limit temperature, overheating of the heater can be prevented.

The ASIC 34 also executes the first current-feed mode in the pre-ON lock time T_onpre as a period prior to arrival of the rear end of the sheet 5 at the nip position N of the fusing unit 7 so that the detection temperature Td becomes equal to or lower than the target temperature TM at Time t4 when the rear end of the sheet 5 arrives at the nip position N of the fusing unit 7. The temperature of the heater rises due to execution of the second current-feed mode of fixing the duty ratio to almost 100%. Thus, by previously setting the detection temperature Td to be equal to or lower than the target temperature Tm, the second current-feed mode of fixing the current-feed ratio to almost 100% can suitably be executed in the above-mentioned ON lock time T_onlock. Therefore, the effect of restraining the harmonic current can be improved while increasing the temperature of the heater, that is, restraining instability of the temperature of the heater. Preferably, by previously setting the detection temperature Td to be not less than lower limit temperature and not more than the target temperature Tm, excessive lowering in the temperature of the heater can be prevented.

<Other Illustrative Aspects>

The present invention is not limited to the illustrative aspect described in the above description and figures, and for example, following illustrative aspects falls within the technical scope of the present invention.

(1) According to the above-mentioned illustrative aspect, in current-feed control of the fusing unit 7, the wave-number duty ratio is used as the current-feed ratio to perform wave-number control of the AC power source AC. However, the present invention is not limited to this. The present invention can be applied to the case where, in current-feed control of the fusing unit 7, a phase duty ratio is used as the current-feed ratio to perform phase control of the AC power source AC.

(2) In the above-mentioned illustrative aspect, the ASIC 34 may execute the second current-feed mode of fixing the duty ratio DUTY to almost 100%, in a period during which the front end of the sheet 5 is located at the nip position (fusing position) N and then, the pressure roller 23 makes a single rotation and after that, the rear end of the sheet 5 is located at the nip position N. In the above-mentioned period, since the temperature of the heater (heater 33) lowers due to absorption of heat by the sheet 5, the second current-feed mode fixing the duty ratio DUTY to almost 100% can suitably be executed. Therefore, the effect of restraining the harmonic current can be improved while increasing the temperature of the heater, that is, restraining instability of the temperature of the heater.

(3) In the above-mentioned illustrative aspect, the ASIC 34 may execute the second current-feed mode of fixing the duty ratio DUTY to almost 0% in a period during which the rear end of the sheet 3 is located at the nip position (fusing position) N and then, the pressure roller 23 makes a single rotation and before the front end of the sheet 5 to be conveyed next is located at the nip position N. Since the temperature tends to rise without absorption of heat by the sheet 5 in the above-mentioned period, by executing the second current-feed mode, the effect of restraining the harmonic current can be improved while restraining instability of the temperature of the heater.

(4) In the above-mentioned illustrative aspect, in the case where the ASIC 34 executes the second current-feed mode of fixing the duty ratio DUTY to almost 0% and then, executes the second current-feed mode of fixing the duty ratio DUTY to almost 100%, the ASIC 34 may start the second current-feed mode of fixing the duty ratio DUTY to almost 100% at the same position on the pressure roller 23 as the position on the pressure roller 23 at the time when the ASIC 34 executes the second current-feed mode of fixing the duty ratio DUTY to almost 0%. In this case, imbalance of temperature on the pressure roller 23 can be reduced, It is preferable to execute the second current-feed mode of fixing the duty ratio DUTY to almost 100% following the execution of the second current-feed mode of fixing the duty ratio DUTY to almost 0%, for example, from Time t2 in FIG. 6. And in this case, each of the periods of the executions (the OFF lock time T_offlock and the ON lock time T_onlock) is preferably equal to a single rotation period of the pressure roller 23.

What is claimed is:

1. An image forming apparatus comprising:

a conveying unit configured to convey a recording medium;

an image forming unit that forms an image on the conveyed recording medium;

a fusing unit including a heater that receives electric power from an AC power source and a rotator that is disposed as opposed to the heater and rotates to convey the recording medium, the fusing unit configured to fuse the image formed on the recording medium to the recording medium due to heating by the heater at a fusing position as a position where the heater and the rotator nip the recording medium therebetween;

a switching circuit configured to switch on/off current-feeding from the AC power source to the heater;

a temperature detector configured to detect temperature of the heater;

a current-feed controller configured to execute a first current-feed mode of changing a current-feed ratio of current-feed time from the AC power source to the heater to unit time by controlling switching of the switching circuit so that the temperature detected by the temperature detector falls within a target range; and a position detector that detects position of the conveyed recording medium, wherein the current-feed controller, during execution of the first current-feed mode in place of the first current-feed mode, executes a second current-feed mode of:

fixing the current-feed ratio to almost 0% in a predetermined period that starts when a front end of the recording medium is located at the fusing position, or fixing the current-feed ratio to almost 100% in a predetermined period that starts when a rear end of the recording medium is located at the fusing position.

2. The image forming apparatus according to claim 1, wherein the current-feed controller executes the second current-feed mode of fixing the current-feed ratio to almost 0% in the predetermined period during which the front end of the recording medium is located at the fusing position and then, the rotator makes a single rotation.

3. The image forming apparatus according to claim 2, wherein the current-feed controller executes the first current-feed mode so that the detection temperature is equal to or higher than a target temperature when the front end of the recording medium is located at the fusing position.

4. The image forming apparatus according to claim 3, wherein the current-feed controller executes the first current-feed mode so that the detection temperature is not less than the target temperature and not more than an upper limit temperature when the front end of the recording medium is located at the fusing position.

5. The image forming apparatus according to claim 1, wherein the current-feed controller executes the second current-feed mode of fixing the current-feed ratio to almost 100% in the predetermined period during which the rear end of the recording medium is located at the fusing position and then, the rotator makes a single rotation.

6. The image forming apparatus according to claim 5, wherein the current-feed controller executes the first current-feed mode so that the detection temperature is equal to or lower than a target temperature when the rear end of the recording medium is located at the fusing position.

7. The image forming apparatus according to claim 6, wherein the current-feed controller executes the first current-feed mode so that the detection temperature is not less than a lower limit temperature and not more than the target temperature when the rear end of the recording medium is located at the fusing position.

8. The image forming apparatus according to claim 5, wherein the current-feed controller executes the second current-feed mode of fixing the current-feed ratio to almost 0% in the predetermined period during which the rear end of the recording medium is located at the fusing position and then, the rotator makes a single rotation and after the predetermined ends, the front end of a recording medium conveyed next is located at the fusing position.

9. The image forming apparatus according to claim 1, wherein each time images are continuously formed on a plurality of recording media, the current-feed controller gradually increases the length of the predetermined period of the second current-feed mode from an initial value.

10. The image forming apparatus according to claim 9, wherein when a feeding source for the recording medium is changed, the current-feed controller resets the length of the predetermined period of the second current-feed mode to the initial value.

11. The image forming apparatus according to claim 1, wherein in the case where the second current-feed mode of fixing the current-feed ratio to almost 0% is executed and then, the second current-feed mode of fixing the current-feed ratio to almost 100%, the current-feed controller starts the second current-feed mode of fixing the current-feed ratio to almost 100% at the same position on the rotator as the position on the rotator at the time when the second current-feed mode of fixing the current-feed ratio to almost 0% is started.

12. An image forming apparatus comprising:

a conveying unit configured to convey a recording medium;

an image forming unit that forms an image on the conveyed recording medium;

a fusing unit including a heater that receives electric power from an AC power source and a rotator that is disposed as opposed to the heater and rotates to convey the recording medium, the fusing unit configured to fuse the image formed on the recording medium to the recording medium due to heating by the heater at a fusing position as a position where the heater and the rotator nip the recording medium therebetween;

a switching circuit configured to switch on/off current-feeding from the AC power source to the heater;

a temperature detector configured to detect temperature of the heater;

a current-feed controller configured to execute a first current-feed mode of changing a current-feed ratio of current-feed time from the AC power source to the heater to unit time by controlling switching of the switching circuit so that the temperature detected by the temperature detector falls within a target range; and a position detector that detects position of the conveyed recording medium, wherein the current-feed controller executes a second current-feed mode of fixing the current-feed ratio to almost 100% or almost 0% during execution of the first current-feed mode in place of the first current-feed mode based on a timing when the position detector detects that an end of the recording medium in a conveying direction is located at the fusing position, and wherein the current-feed controller executes the second current-feed mode of fixing the current-feed ratio to almost 100% in a period during which a front end of the recording medium is located at the fusing position and then, the rotator makes a single rotation and before a rear end of the recording medium is located at the fusing position.

13. An image forming apparatus comprising:

a conveying unit configured to convey a recording medium;

an image forming unit that forms an image on the conveyed recording medium;

a fusing unit including a heater that receives electric power from an AC power source and a rotator that is disposed as opposed to the heater and rotates to convey the recording medium, the fusing unit configured to fuse the image formed on the recording medium to the recording medium due to heating by the heater at a fusing position as a position where the heater and the rotator nip the recording medium therebetween;

a switching circuit configured to switch on/off current-feeding from the AC power source to the heater;

a temperature detector configured to detect temperature of the heater;

a current-feed controller configured to execute a first current-feed mode of changing a current-feed ratio of current-feed time from the AC power source to the heater to unit time by controlling switching of the switching circuit so that the temperature detected by the temperature detector falls within a target range; and a position detector that detects position of the conveyed recording medium, wherein the current-feed controller executes a second current-feed mode of fixing the current-feed ratio to almost 100% or almost 0% during execution of the first current-feed mode in place of the first current-feed mode based on a timing when the position detector detects that an end of the recording medium in a conveying direction is located at the fusing position, wherein, each time images are continuously formed on a plurality of recording media, the current-feed controller gradually increases an execution period of the second current-feed mode from an initial value, and wherein, when a feeding source for the recording medium is changed, the current-feed controller resets the execution period of the second current-feed mode to the initial value.

14. An image forming apparatus comprising:

a conveying unit configured to convey a recording medium;

an image forming unit that forms an image on the conveyed recording medium;

a fusing unit including a heater that receives electric power from an AC power source and a rotator that is disposed as opposed to the heater and rotates to convey the recording medium, the fusing unit configured to fuse the image formed on the recording medium to the recording medium due to heating by the heater at a fusing position as a position where the heater and the rotator nip the recording medium therebetween;

a switching circuit configured to switch on/off current-feeding from the AC power source to the heater;

a temperature detector configured to detect temperature of the heater;

a current-feed controller configured to execute a first current-feed mode of changing a current-feed ratio of current-feed time from the AC power source to the heater to unit time by controlling switching of the switching circuit so that the temperature detected by the temperature detector falls within a target range; and a position detector that detects position of the conveyed recording medium, wherein the current-feed controller executes a second current-feed mode of fixing the current-feed ratio to almost 100% or almost 0% during execution of the first current-feed mode in place of the first current-feed mode based on a timing when the position detector detects that an end of the recording medium in a conveying direction is located at the fusing position, wherein, in the case where the second current-feed mode of fixing the current-feed ratio to almost 0% is executed and then, the second current-feed mode of fixing the current-feed ratio to almost 100%, the current-feed controller starts the second current-feed mode of fixing the current-feed ratio to almost 100% at the same position on the rotator as the position on the rotator at the time when the second current-feed mode of fixing the current-feed ratio to almost 0% is started.

* * * * *